US006349732B1

(12) United States Patent
Cooper

(10) Patent No.: US 6,349,732 B1
(45) Date of Patent: Feb. 26, 2002

(54) COLLAPSIBLE SMALL VEHICLE ENCLOSURE

(76) Inventor: Mark T. Cooper, 2660 Lafayette Dr., Boulder, CO (US) 80303

( * ) Notice: Subject to any disclaimer, the term of this patent is extended or adjusted under 35 U.S.C. 154(b) by 0 days.

(21) Appl. No.: 09/175,815

(22) Filed: Oct. 20, 1998

(51) Int. Cl.[7] ..... E04H 15/36

(52) U.S. Cl. ..... 135/133; 135/116; 135/134; 135/148; 52/66

(58) Field of Search ..... 55/66, 67; 135/88.01, 135/87, 88.13, 116, 128, 88.06, 133, 134, 148

(56) References Cited

U.S. PATENT DOCUMENTS

| | | | | |
|---|---|---|---|---|
| 1,572,790 A | | 2/1926 | Grigsby | |
| 3,161,231 A | | 12/1964 | Dawson et al. | |
| 3,797,178 A | | 3/1974 | Mule | |
| 3,861,092 A | | 1/1975 | Dale et al. | |
| 3,906,968 A | | 9/1975 | Black | |
| 3,945,159 A | | 3/1976 | Girnus, Sr. | |
| 4,084,599 A | | 4/1978 | Matthews | |
| 4,306,390 A | | 12/1981 | Brown | |
| 4,800,701 A | * | 1/1989 | Dunsworth | 52/66 |
| 4,982,971 A | | 1/1991 | Marin | |
| 5,059,463 A | * | 10/1991 | Peters | 135/95 |
| 5,265,385 A | | 11/1993 | Smith et al. | |
| 5,313,972 A | * | 5/1994 | Goldberg | 135/88.01 |
| 5,369,920 A | | 12/1994 | Taylor | |
| 5,414,966 A | * | 5/1995 | Montoya | 135/88.06 |
| 5,625,982 A | * | 5/1997 | Foote | 52/64 |
| 5,690,134 A | * | 11/1997 | McCauley | 135/133 |
| 5,746,237 A | * | 5/1998 | Arnic | 135/88.06 |

* cited by examiner

*Primary Examiner*—Beth A. Stephan

(57) ABSTRACT

A collapsible enclosure that generally comprises a symmetrical pair of base members and a pliable protective cover supported by a plurality of internal frame members pivotally connected on the axis of the hinge points for the base members. By manually rotating the first frame member about its axis, the protective cover and additional frame members unfurl over the base members and surround a vehicle or object in a shell-shaped enclosure. To store or transport the enclosure, the protective cover and frame members collapse in an accordion-like fashion and sandwich between the folded base members.

6 Claims, 4 Drawing Sheets

COLLAPSIBLE SMALL VEHICLE ENCLOSURE

BACKGROUND

1. Field of Invention

This invention relates generally to collapsible enclosures for storing and protecting objects or small vehicles and specifically, to such collapsible enclosures which are used for motorcycles and bicycles.

2. Description of Prior Art

Many motorcycle and bicycle owners face finding suitable storage for their vehicle that provides adequate protection from the elements. Specifically designed vehicle covers made of cloth or plastic material are available but do not fully enclose a vehicle and offer inadequate protection. Debris and moisture that enter through gaps at anchor and tie points may damage a vehicle. Additionally, material in covers readily cracks or rots in a short time and subsequently exposes a vehicle to adverse elements.

Many prior art storage enclosures are bulky and therefore, inappropriate for use in a limited space. Most designs are to accommodate vehicles of various sizes, for example, a motorcycle, snowmobile, Jet Ski, and ATV. Consequently, their use requires a large area. For use at apartment and condominium complexes, it is often restricted to construct such bulky and unattractive storage devices. Basically, they are impractical.

While many prior art storage enclosures collapse or disassemble, they are still prohibitively heavy and awkward. Some require the assistance of a lifting means or more than one person to transport. Moreover, storing such a device when they are not in use often requires a large space.

Other storage devices are prohibitively expensive and require complicated assembly. Some manufactured from wood, plastic, fiberglass or aluminum require detailed instruction for assemblage and usage. This process can be both time consuming and difficult.

A number of inventors have created storage devices that fully enclose a small vehicle. U.S. Pat. Nos. 5,369,920 to Taylor (1994), 5,265,385 to Smith et al. (1993) and 4,306,390 to Brown (1981) disclose relatively large storage devices that are constructed from heavy materials. Enclosures with ridged, one-piece cover member have also been proposed—for example, U.S. Pat. Nos. 4,982,971 (1991), 3,945,159 (1976), 3,797,178 (1974), and 3,861,092 (1973). All of these known devices suffer from a number of disadvantages:

(a) They are particularly large in order to accommodate vehicles of various sizes. To house a snowmobile, Jet Ski, ATV or like vehicle requires a much larger structure than for a motorcycle or bicycle. Consequently, a bulky storage device is inappropriate at apartment complexes.

(b) Their excessive weight hampers ease of portability. In order to deter theft of the storage enclosure, prior inventions have sought to make the device prohibitively heavy. This feature hinders portability and handling by only one person.

(c) Assemblage is complicated, time-consuming and requires considerable effort.

(d) There is the problem of storing the device when not in use. Although some enclosures disassemble, they still lack the compactness needed to be stored in a small space, especially for those living in apartment complexes.

(e) The use of excessive and costly materials has made these devices expensive to manufacture and thus exorbitant to purchase.

(f) Most apartment and condominium complexes prohibit the construction of bulky enclosures because of space limitations and because of their unattractiveness.

(g) The design and shape of the enclosures are box-like or massive in appearance and do not compliment a vehicle.

Therefore, there has been a need for an improved small vehicle enclosure that requires no assembly and is simple to operate. Furthermore, there is a need for an enclosure that is collapsible, compact, lightweight, portable, aesthetically appealing and inexpensive.

SUMMARY OF THE INVENTION

This invention overcomes the above-mentioned disadvantages by providing a collapsible, compact, lightweight and portable small vehicle enclosure designed specifically for motorcycles and bicycles. The present invention is a collapsible enclosure and it generally comprises a symmetrical pair of base members and a pliable protective cover supported by a plurality of internal frame members pivotally connected at the axis of the hinge points for the base members. There is no assemblage involved. One end of the protective cover permanently attaches to the periphery of one of the base members. By grasping the first frame member and manually rotating it about its axis, the protective cover and additional frame members are unfurled and stop at predetermined positions. A latching means secures the cover to the base. Skirting attached to the cover fastens to the periphery of the second base member to seal the enclosure. When not in use, the base members fold together to sandwich between them the protective cover and frame members.

Several objects and advantages of the present invention are:

(a) to provide an enclosure that is specifically designed for motorcycles and bicycles;

(b) to provide an enclosure that entirely surrounds and protects a vehicle against adverse human and environmental elements;

(c) to provide an enclosure that requires no assemblage;

(d) to provide an enclosure that is relatively lightweight and can easily be transported by one person;

(e) to provide an enclosure that is both collapsible and compact for storage in a small space;

(f) to provide an enclosure that has an aesthetic design;

(g) to provide an enclosure that is simple to operate; and (h) to provide an enclosure that is relatively inexpensive to manufacture.

Further objects and advantages are to provide a vehicle enclosure that is usable at housing complexes and compliments the design and shape of a motorcycle or bicycle. Still further objects and advantages will become apparent from a consideration of the ensuing description and drawings.

DETAILED DESCRIPTION OF THE PRESENT INVENTION

Figure 1:
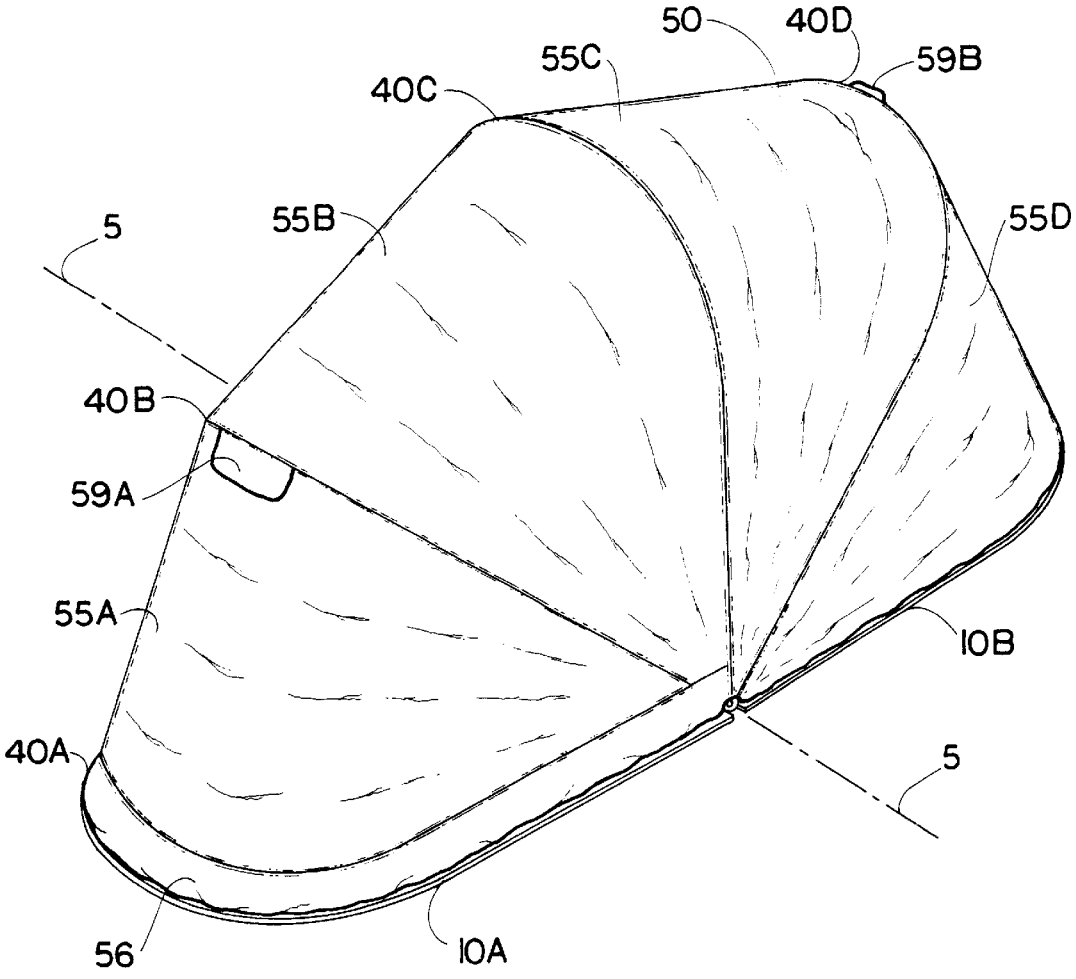
FIG. 1 is a perspective view of the enclosure of the present invention.

A typical embodiment of the collapsible small vehicle enclosure of the present invention is illustrated in FIG. 1.

The enclosure is comprised of a platform consisting of base members 10*a* and 10*b*, four ridged frame members 40*a*, 40*b*, 40*c* and 40*d* and a pliable cover 50.

Figure 2:
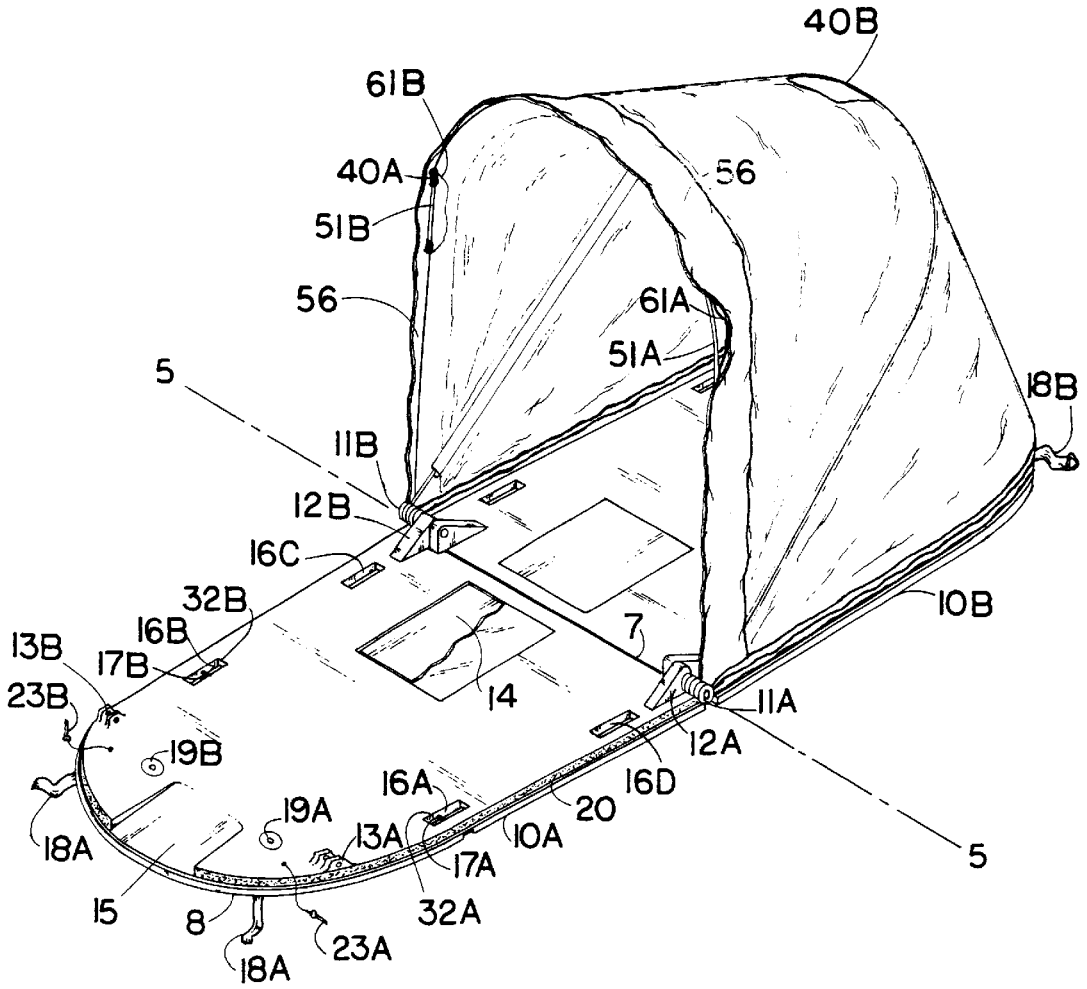
FIG. 2 is a perspective view of the enclosure in a partially opened position.
Figure 4:
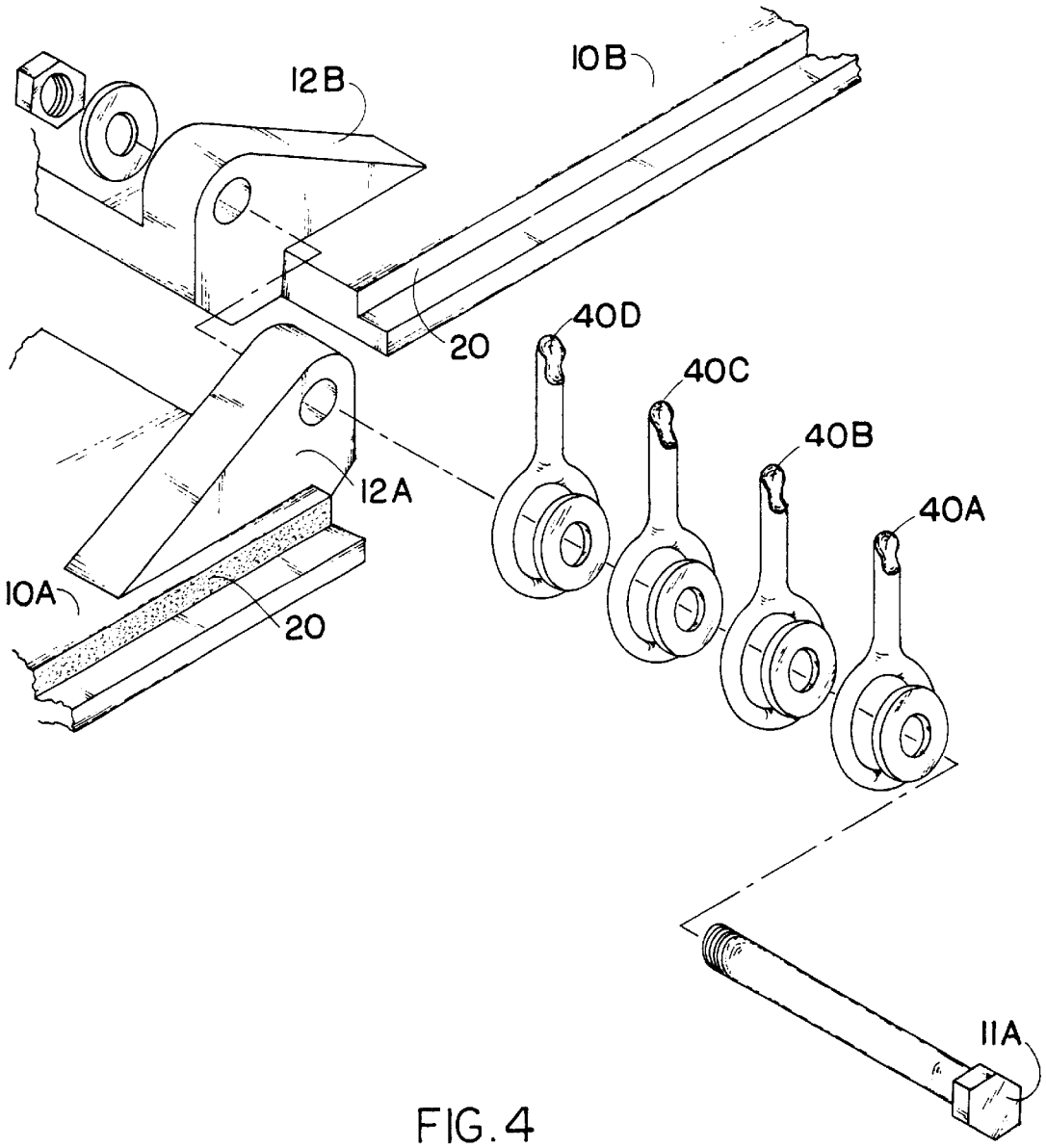
FIG. 4 is an exploded perspective view of the pivotal area of the present invention.

Base members 10*a* and 10*b* are symmetrical and constructed of rigid material, preferrably plastic, so as to be able to support a vehicle or other article that is stored within the enclosure. As shown in FIG. 2, located at the abut end 7 of base member 10*a* and 10*b* are protruding hinge supports 12*a* and 12*b* that are positioned so that they will align adjacent to the opposite of each other when base members 10*a* and 10*b* are abutted. For example, hinge support 12*a* on base member 10*a* will align adjacent to hinge support 12*b* on base member 10*b* and likewise hinge support 12*b* on base member 10*a* will align adjacent to hinge support 12*a* on base member 10*b*. As best shown in FIG. 4, pivotal bolts 11*a* and 11*b* pass through corresponding holes in the hinge supports to join the base members. Thus, pivotal bolt 11*a* and pivotal bolt 11*b* align on a single axis 5.

As shown in FIG. 2, located on the outer edge and toward arched end 8 of base member 10*a* are latch areas 13*a* and 13*b*. Latch areas 13*a* and 13*b* consist of a pair of closely adjacent latch lobes protruding upwardly from the surface of base member 10*a*. The latch lobes have corresponding holes that line up and register latch pins 23*a* and 23*b*. Latch areas 13*a* and 13*b* are located on base member 10*a* to receive frame member 40*a* in the gap existing between the lobes. Inserting latch pins 23*a* and 23*b* directly over frame member 40*a* securely holds the frame member to base member 10*a*. A padlock can be replaced for one or both pins 23*a* and 23*b* to prevent the raising of frame member 40*a* and thus tampering with the contents of the enclosure.

Referring again to FIG. 2, in order to provide added support and protection to the center area of the platform, a rectangular plate 14 is secured to base member 10*a* or 10*b*. Plate 14 also serves as a center kickstand and drip pan for a vehicle parked on the platform. At the arched end 8 of base member 10*a* is a sloping channel 15 making it easier to roll a vehicle onto the platform. Extending along the periphery of the base member is a recessed ledge or lip 20 as best shown in FIG. 4. On base member 10*a*, lip 20 serves as the location for one half of a hook and loop fastener. Skirt 56 has the other half of the loop and hook fastener sewn to it in order to seal the skirt to the periphery of base member 10*a*. On base member 10*b*, ledge 20 serves as the location to permanently attach cover 50.

Figure 3:
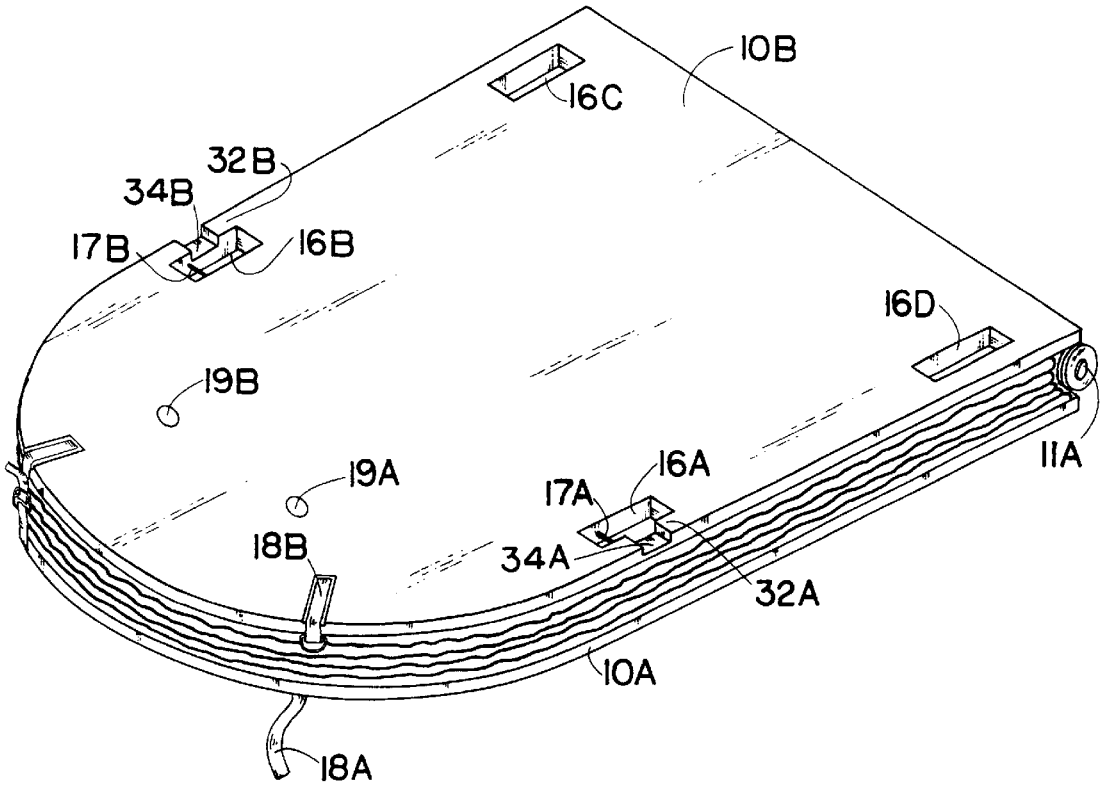
FIG. 3 is a perspective view of the enclosure in a folded position.

As shown in FIG. 2 and FIG. 3, base members 10*a* and 10*b* have four hollowed grasping slots 16*a*, 16*b*, 16*c* and 16*d* that east in lifting, carrying and transporting a folded enclosure. Grasping slots 16*a* and 16*b* also form handles 32*a* and 32*b* in order that base member 10*a* pivots about axis 5 from a folded position, as shown in FIG. 3, to an opened position, as shown in FIG. 2. Interposed horizontally in the hollowed area of grasping slots 16*a* and 16*b* are dowels 17*a* and 17*b* to which tie-down hooks or other means for securing items in the enclosure can be attached. Indents 34*a* and 34*b* provide for the attachment of a cable or chain around handles 32*a* and 32*b* to avoid pinching between the bottom surface of the base member and the ground.

As shown in FIG. 2, anchor holes 19*a* and 19*b* pass through base members 10*a* and 10*b* in order to provide for an anchoring means to the ground by use of a nail, bolt or other type of suitable fastener. A circular channel is recessed into the top surface of the base member and around anchor holes 19*a* and 19*b* in order to accommodate a flat washer used with an anchoring means. Located at arched end 8 of base member 10*a* are straps 18*a* and 18*b* that are used to secure base members 10*a* and 10*b* together when in a folded position as shown in FIG. 3.

As shown in FIG. 2 and FIG. 4, frame members 40*a*–40*d* are pivotally secured to base members 10*a* and 10*b* by pivotal bolts 11*a* and 11*b* at integral hinge supports 12*a* and 12*b*. Frame members 40*a*–40*d* are rigid and have the same parabolic shape as the base members. Construction of a frame member can be manufactured from a single piece of material or from different materials. As best shown in FIG. 2, latch sections 51*a* and 51*b* are sections of frame member 40*a* that register in the gaps between the lobes at latch areas 13*a* and 13*b*. Frame member 40*a* secures to base member 10*a* when pins 23*a* and 23*b* are inserted over the frame member.

As shown in FIG. 1, cover 50 is constructed of a pliable material, preferrably vinyl or nylon fabric. Cover 50 consists primarily of four elliptical sections 55*a*, 55*b* 55*c* and 55*d* that are sewn together. Located at the seams that join the sections are sleeves that house frame members 40*a*–40*d*. Located at latch sections 51*a* and 51*b* on section 55*a* are cut out areas 61*a* and 61*b* which are large enough to allow a hand to freely grasp frame member 40*a* and rotate it about axis 5.

Referring again to FIG. 1, a skirt 56 is attached to the perimeter of section 55*a*. Skirt 56 seals cover 50 to the periphery of base member 10*a*. The placement of ventilation flaps 59*a* and 59*b* are located in the middle of the enclosure at the seams between sections 55*a* and 55*b* and sections 55*c* and 55*d* respectively. The ventilation flaps are downwardly facing over a screened opening in sections 55*b* and 55*d*. Such flaps permit ventilation of the enclosure while protecting its contents from moisture.

Operation of the Present Invention

An operator of the present invention places a folded enclosure, as shown in FIG. 3, with base member 10*b* onto a flat surface and unlatches straps 18*a* and 18*b*. An operator then grasps either handle 32*a* or 32*b* and rotates base member 10*a* about axis 5 until base members 10*a* and 10*b* abut. The use of a nail, bolt or other type of suitable fastener through anchor holes 19*a* and 19*b* will anchor the platform to the ground. A locking mechanism such as a chain or cable can be placed around grasping handle 32*a* or 32*b* to secure the platform to a fixture. A vehicle with a center kickstand is positioned directly over plate 14 for added support and protection to the platform. Articles or a vehicle placed on the platform can be secured by attaching tie-down straps or rope to dowel 17*a* and 17*b* located in grasping slots 16*a* and 16*b*.

An operator unfurls cover 50 by grasping frame member 40*a* through cut out areas 61*a* or 61*b* and lifting it upwardly to rotate about pivotal axis 5. As frame member 40*a* rotates, frame members 40*b*–40*d* also rotate about pivotal axis 5 and stop at their respective positions in relation to the sleeves in which they are housed between sections 55*b*–55*d*. Frame member 40*a* registers in the gaps between the lobes at latch areas 13*a* and 13*b* on base member 10*a*. Pins 23*a* and 23*b* are placed through the corresponding holes in the lobes and over frame member 40*a* thus holding it down securely to the base member. If an operator desires to prevent opening of the enclosure, a padlock can be used to replace pin 23*a* or 23*b*. Cover 50 is secured to base member 10*a* by the attachment of skirt 56 by a fastener means located on ridge 20.

The present invention described above is a collapsible, compact, lightweight and portable enclosure. There is no assemblage involved and it can be stored in a relatively small space. Although the present invention has been adapted for use as a small vehicle enclosure, especially a motorcycle, it also is well suited for enclosing other articles or used for other purposes. For example, a fishing shelter, a duck blind or a sleeping shelter to name a few. To accommodate smaller or larger contents, the size of the enclosure can be manufactured accordingly. The materials used in the construction of the present invention are plastic, steel, aluminum, fiberglass and polyester vinyl. Other materials may be substituted and different manufacturing and attachment techniques may be employed within the scope and spirit of the invention.

I claim:

1. A collapsible storage enclosure comprising:

first and second base members, each said base member having a top surface and a bottom surface, a straight side edge, each said straight side edge having a first and a second opposed end, and a peripheral edge connecting said first and second opposed straight side edge ends around said top and bottom surfaces;

means for pivotally joining said straight edges of said first and second base members with said straight side edges substantially adjacent one another for pivotal movement of said first and second base members from a closed position with said top surfaces of said first and second base members substantially adjacent one another to an open horizontal position to form a platform;

a plurality of arched frame members, each said arched frame member terminating in a first and second opposed end, each said first end of each said arched frame member pivotally mounted adjacent said first ends of said substantially abutted straight side edges of said first and second base members, and each said second end of each said arched frame member pivotally mounted adjacent said second ends of said substantially abutted straight side edges of said first and second base members, each said arched frame member being mounted for rotational movement from a collapsed position substantially adjacent said top surface of said first base member to a raised position in a predetermined spaced apart arrangement above said top surfaces of said first and second base members when said first and second base members are in an open horizontal position to form a platform; and a pliable cover arranged and secured to each of said plurality of arched frame members at predetermined spaced positions such that when said arched frame members are in a collapsed position said pliable cover folds and when said first and second base members are in a closed position with said top surfaces substantially adjacent one another said pliable cover folds and collapses substantially between said first and second base members, and when said first and second base members are in an open horizontal position to form a platform and said arched frame members are pivotally rotated to said raised position said pliable cover unfurls between said arched frame members and above said top surfaces of said first and second base members to form a storage enclosure.

2. The collapsible storage enclosure of claim 1, wherein said first and second base members pivotally rotate to sandwich said plurality of arched frame members and said pliable cover between said first and second base members.

3. The collapsible storage enclosure of claim 1, wherein said plurality of arched frame members having their first and second opposed ends pivotally connected at said straight side edges of said first and second base members are arranged horizontally substantially about a single axis.

4. The collapsible storage enclosure of claim 1, further comprising a latching means disposed on said first and second base members for attaching and locking said pliable cover when said cover is unfurled to form a storage enclosure.

5. The collapsible storage enclosure of claim 1, further comprising an anchoring means disposed on said first and second base members for anchoring said first and second base members to the ground or other surface supporting said base members.

6. The collapsible storage enclosure of claim 1, further comprising a fastening means for said pliable cover to and around said peripheral edges of said first and second base members.

* * * * *